US009181624B2

(12) United States Patent
Sugiyama et al.

(10) Patent No.: US 9,181,624 B2
(45) Date of Patent: Nov. 10, 2015

(54) METHOD OF ELECTROLYSIS EMPLOYING TWO-CHAMBER ION EXCHANGE MEMBRANE ELECTROLYTIC CELL HAVING GAS DIFFUSION ELECTRODE

(75) Inventors: Mikihito Sugiyama, Akashi (JP); Yukinori Iguchi, Tamano (JP); Kiyohito Asaumi, Tamano (JP)

(73) Assignees: CHLORINE ENGINEERS CORP., LTD., Tokyo (JP); KANEKA CORPORATION, Osaka (JP); TOAGOSEI CO., LTD., Tokyo (JP)

( * ) Notice: Subject to any disclaimer, the term of this patent is extended or adjusted under 35 U.S.C. 154(b) by 869 days.

(21) Appl. No.: 13/263,007

(22) PCT Filed: Apr. 15, 2010

(86) PCT No.: PCT/JP2010/056744

§ 371 (c)(1),
(2), (4) Date: Oct. 25, 2011

(87) PCT Pub. No.: WO2010/119918

PCT Pub. Date: Oct. 21, 2010

(65) Prior Publication Data

US 2012/0048743 A1 Mar. 1, 2012

(30) Foreign Application Priority Data

Apr. 16, 2009 (JP) ..... 2009-099846

(51) Int. Cl.
*C25B 1/16* (2006.01)
*C25B 1/46* (2006.01)
*C25B 15/02* (2006.01)

(52) U.S. Cl.
CPC ... *C25B 1/46* (2013.01); *C25B 1/16* (2013.01); *C25B 15/02* (2013.01)

(58) Field of Classification Search
USPC ..... 205/465, 466, 516, 537
See application file for complete search history.

(56) References Cited

U.S. PATENT DOCUMENTS 4,105,514 A 8/1978 Justice et al.
4,364,805 A 12/1982 Rogers (Continued)

FOREIGN PATENT DOCUMENTS

CN 1133355 10/1996
EP 0 296 736 12/1988

(Continued)

OTHER PUBLICATIONS

Supplementary European Search Report dated Sep. 6, 2012 issued by European Patent Office in counterpart Patent Application No. EP 10 76 4500.4.

(Continued)

*Primary Examiner* — Arun S Phasge
(74) *Attorney, Agent, or Firm* — Young & Thompson

(57) ABSTRACT

Disclosed is an electrolysis method, whereby sodium chloride concentration of an aqueous caustic soda solution formed through electrolysis in a two-chamber ion-exchange membrane sodium chloride electrolytic cell, which is equipped with a gas diffusion electrode as a cathode and divided into an anode chamber containing an anode and a cathode gas chamber containing the cathode that are partitioned by an ion-exchange membrane, is lowered. In a two-chamber ion-exchange membrane electrolytic cell (1) using a gas diffusion electrode (7), electrolysis is performed while reducing the pressure difference between the liquid pressure in the anode chamber and the gas pressure in the cathode gas chamber, i.e., the pressure calculated by subtracting [oxygen-containing gas pressure in cathode chamber (measured by manometer (18))] or [gas pressure at oxygen-containing gas inlet (14)] from [(liquid pressure in anode chamber applied to ion-exchange membrane when anode chamber is filled up with aqueous sodium chloride solution) being equal to (depth of aqueous sodium chloride solution)(density of aqueous sodium chloride solution)/2].

8 Claims, 2 Drawing Sheets

(56) References Cited

U.S. PATENT DOCUMENTS

| | | | | |
|---|---|---|---|---|
| 4,379,034 | A * | 4/1983 | Rogers | 205/531 |
| 4,902,397 | A | 2/1990 | Kelham | |
| 4,969,981 | A * | 11/1990 | Rogers et al. | 205/466 |
| 5,411,641 | A | 5/1995 | Trainham, III et al. | |
| 5,693,202 | A | 12/1997 | Gestermann et al. | |
| 6,790,339 | B2 | 9/2004 | Bulan et al. | |
| 7,083,708 | B2 * | 8/2006 | Chlistunoff et al. | 204/252 |
| 2003/0024824 | A1 | 2/2003 | Bulan et al. | |
| 2009/0071820 | A1 | 3/2009 | Saiki et al. | |

FOREIGN PATENT DOCUMENTS

| | | |
|---|---|---|
| EP | 1 882 758 | 1/2008 |
| JP | 54-087696 | 7/1979 |
| JP | 62-093388 | 4/1987 |
| JP | 5-255883 | 10/1993 |
| JP | 5-339771 | 12/1993 |
| JP | 11-124698 | 5/1999 |
| JP | 2000-064074 | 2/2000 |
| JP | 2001-323084 | 11/2001 |
| JP | 2003049290 | 2/2003 |
| JP | 2006-322018 | 11/2006 |

OTHER PUBLICATIONS

International Search Report, PCT/JP2010/056744, Jul. 20, 2010.
Chinese Official Action—201080016585.6—Oct. 12, 2013.

* cited by examiner

Relation Between the Number of Days at Each Pressurization of Cathode Gas Chamber (Excluding Example 3)

METHOD OF ELECTROLYSIS EMPLOYING TWO-CHAMBER ION EXCHANGE MEMBRANE ELECTROLYTIC CELL HAVING GAS DIFFUSION ELECTRODE

TECHNICAL FIELD

The present invention relates to a method of electrolysis employing a two-chamber ion exchange membrane electrolytic cell having a gas diffusion electrode, and a method of producing chorine or caustic soda by using the above method of electrolysis.

BACKGROUND ART

An ion exchange membrane method is well-known which produces chlorine and a caustic soda aqueous solution by electrolyzing saturated brine by means of a gas diffusion electrode. In this method, an electrolytic cell is divided, by an ion exchange membrane, into an anode chamber equipped with an anode and filled with brine, and a cathode chamber equipped with a cathode and filled with a caustic soda aqueous solution. The electrolysis is carried out by feeding current between the above two electrodes while oxygen-containing gas (oxygen concentration is 100% to 20%) is supplied into the cathode chamber to produce the caustic soda aqueous solution and the chorine in the cathode chamber and the anode chamber, respectively.

The electrolyzing method using the gas diffusion electrode as the cathode enables the reductions of the theoretical decomposition voltage by about 1 V and of the power cost by about 30% compared with those of an ordinary hydrogen-evolving electrolyzing method because no hydrogen evolves on the cathode in the former. Various studies are conducted for bringing the above brine electrolysis using the gas diffusion electrode to the practical use. In this regard, Patent Publications 1 and 2 propose, as a means of further reducing the electrolysis voltage, a method in which a cathode liquid chamber is substantially removed by intimately adhering the gas diffusion electrode to an ion exchange membrane, or the cathode chamber is configured as a gas chamber (this method is referred to as a two-chamber method because the electrolytic cell consists of the anode chamber and the cathode gas chamber). This method advantageously reduces the electric resistance to the lowest limit to maintain the electrolysis voltage minimum because no gap for catholyte exists between the ion exchange membrane and the cathode.

Patent Publication 3 discloses a brine electrolytic cell equipped with a gas diffusion electrode in a cathode chamber in which the electrolysis is conducted while the cathode chamber containing catholyte and oxygen-containing gas is pressurized (three-chamber ion exchange membrane electrolytic cell). In Patent Publication 3, the cathode chamber is pressurized for realizing the intimate contact between the gas diffusion electrode and the ion exchange membrane.

PRIOR ART PUBLICATIONS

Patent Publications

Patent Publication 1: JP-A-11 (1999)-124698

Patent Publication 2: JP-A-2006-322018

Patent Publication 3: JP-A-2000-64074 (paragraphs 0012 and 0015)

SUMMARY OF THE INVENTION

Problems to be Solved by the Invention

In these Patent Publications relating to the methods of the ion exchange membrane brine electrolysis using the gas diffusion electrode, attention is paid only to the fabrication and the performance upgrade of the gas diffusion electrode and little consideration is taken to the quality of the caustic soda aqueous solution produced by the electrolysis. This brine electrolysis using the two-chamber ion exchange membrane electrolytic cell includes a problem that the salt concentration in the caustic soda aqueous solution reaches 100 ppm at the early stage of the electrolysis followed by its continuous upward trend, thereby causing the stoppage of the electrolysis.

Accordingly, an object of the present invention is to provide a method of electrolysis in which a salt concentration in a caustic soda aqueous solution produced in the two-chamber ion exchange membrane electrolysis is reduced.

Means for Overcoming the Problems

The problems have been overcome by the finding, after the repeated studies thereon, that the salt concentration in the caustic soda aqueous solution electrolytically produced can be reduced when the electrolysis is conducted while the interior of the cathode gas chamber of the two-chamber ion exchange membrane electrolytic cell is pressurized.

In accordance with the present invention, the above problems can be overcome as follows.

(1) A method of electrolyzing brine using a two-chamber ion exchange membrane electrolytic cell divided, by means of an ion exchange membrane, into an anode chamber equipped with an anode and a cathode gas chamber equipped with a gas diffusion electrode, wherein a differential pressure which equals to a difference between a liquid pressure in the anode chamber and a gas pressure in the cathode gas chamber (="liquid pressure in anode chamber"−"gas pressure in cathode gas chamber") is reduced, by pressurizing an inside of the cathode gas chamber, compared with that at non-pressurizing, thereby decreasing a salt concentration in a caustic soda aqueous solution electrolytically produced.

(2) In the above item (1), the differential pressure is made to 2.4 kPa or less by pressurizing the inside of the cathode gas chamber.

(3) In the above item (1), the differential pressure is made to −21.6 kPa or more by pressurizing the inside of the cathode gas chamber.

(4) In any one of the above items (1) to (3), a gas pressure of an oxygen-containing gas in the cathode gas chamber is increased to pressurize the inside of the cathode gas chamber.

(5) Chlorine is produced by employing the method of the present invention.

(6) Caustic soda is produced by employing the method of the present invention.

The liquid pressure in the anode chamber refers to a pressure brine pushes an ion exchange membrane at the middle point of the height of the brine in the anode chamber when the anode chamber is filled with the brine, and is calculated as "pressure in anode chamber"="height of brine"×"brine density"÷2. When, for example, the brine height in the anode chamber is 600 mm and the brine density is 1.12 g/ml, the liquid pressure in the anode chamber is about 3.4 kPa as calculated by 600 mm×1.12 g/ml÷2.

The reasons may be speculated as follows why the salt concentration in the caustic soda aqueous solution produced in the cathode gas chamber can be reduced or maintained low when the electrolysis is conducted while cathode gas chamber of the two-chamber ion exchange membrane brine electrolytic cell accommodating the gas diffusion electrode is pressurized.

Since the salt in the caustic soda aqueous solution in the cathode gas chamber increases its concentration by the movement of the brine supplied to the anode chamber into the cathode gas chamber, it is supposed that the suppression of the salt movement can reduce the salt concentration in the caustic soda aqueous solution. Accordingly, the increase of the gas pressure in the cathode gas chamber has been examined as its specific and realizable means.

The cathode gas chamber may be pressurized even if a slight degree, actually pressurized at 1 kPa or more, with respect to the cathode chamber inner pressure during the ordinary operation. The pressurization of the interior of the cathode gas chamber reduces the differential pressure between the liquid pressure in the anode chamber and the gas pressure in the cathode gas chamber when compared with that under non-pressurization, thereby generating the effects of the cathode gas chamber pressurization. When the cathode gas chamber pressurization becomes stronger, the gas pressure in the cathode gas chamber becomes larger than the liquid pressure in the anode chamber (the differential pressure has a negative value). The cathode gas chamber may be pressurized until the pressure reaches the withstand pressure of the electrolytic cell, and the electrolysis is conducted while the gas pressure smaller than the withstand pressure of the electrolytic cell is applied to the cathode gas chamber. The withstand pressure in this context refers to the minimum value of the gas pressure having a lower value selected from the gas pressure which physically destroys the electrolytic cell and the gas pressure applied to the electrolytic cell which lowers the performance thereof.

The present invention does not intend to especially restrict a pressurizing means to any specific means. For example, a sealing pot may be connected in a pipe at the outlet of a caustic soda aqueous solution of the cathode gas chamber, and the pressure in the sealing pot may be applied to the interior of the cathode gas chamber through the above pipe. Further, the cathode gas chamber pressurization may be performed by the switching of a valve equipped in the pipe. The pressurization is desirably conducted by the increase of an oxygen-containing gas in the cathode gas chamber.

The pressurization may be performed from the beginning of the operation or after the salt concentration in the caustic soda aqueous solution reaches a specific concentration, for example, 100 ppm. It is preferable to pressurize from the beginning.

Effects of Invention

In accordance with the present invention, the salt concentration in the caustic soda aqueous solution electrolytically produced can be reduced or maintained below the specific value without discontinuing the electrolysis, thereby improving the quality of the produced caustic soda aqueous solution without exerting the adverse effects on the actual operation.

In accordance with the present invention, the caustic soda aqueous solution having further excellent quality can be obtained and the conditions of the pressurization can be more specified.

Also, chlorine or caustic soda can be produced without discontinuing the electrolysis while the salt concentration in the caustic soda aqueous solution electrolytically produced is reduced or maintained below the specific value.

EMBODIMENTS FOR IMPLEMENTING THE INVENTION

Figure 1:
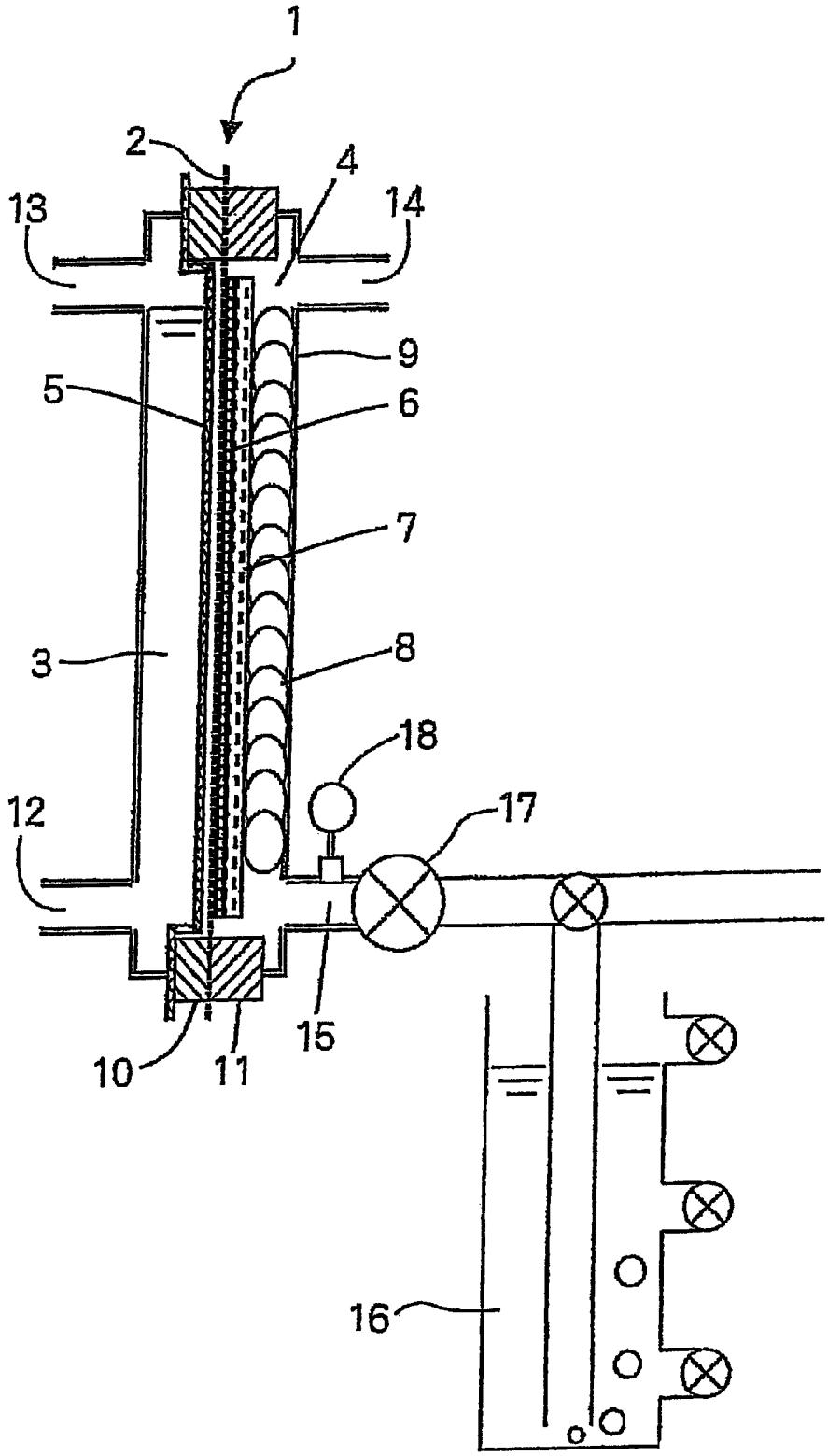
FIG. 1 is a view showing the structure of a two-chamber ion exchange membrane electrolytic cell in accordance with the present invention.

An example of a two-chamber ion exchange membrane electrolytic cell employed in the present invention will be described referring to FIG. 1. An electrolytic cell main body 1 is divided into an anode chamber 3 and a cathode gas chamber 4 by means of an ion exchange membrane 2. A mesh-shaped insoluble anode 5 is in intimate contact with the ion exchange membrane 2 on its anode chamber side. A gas diffusion electrode 7 is in intimate contact with the ion exchange membrane 2 on its cathode gas chamber side sandwiching a hydrophilic layer 6 made of carbon fibers therebetween. The cathode gas chamber 4 is configured as a cathode gas chamber. A cushion 8 made of a metal coil is accommodated between the gas diffusion electrode 7 and a cathode gas chamber back plate (cathode terminal), or in the cathode gas chamber 4.

An anode gasket 10 prevents the leakage of anolyte from the electrolytic cell, and a cathode gasket 11 is similarly mounted. The anode gasket 10 and the cathode gasket 11 sandwich and fix the ion exchange membrane 2.

An anolyte inlet 12 and an anolyte and chlorine gas outlet 13 are mounted at the bottom portion and the top portion of the anode chamber, respectively. An oxygen-containing gas inlet 14 and an outlet 15 for the caustic soda aqueous solution and the excessive oxygen-containing gas are mounted at the top portion and the bottom portion of the cathode gas chamber, respectively. The pressure in the cathode gas chamber is controllable by installing a manometer 18, a sealing pot 16 and a valve 17 downstream of the outlet 15 for the caustic soda aqueous solution.

Then, a method of electrolysis employing the electrolytic cell of FIG. 1 will be described.

Current is supplied to both of the electrodes 5, 7 while brine is supplied to the anode chamber 3 of the electrolytic cell main body 1 through the anolyte inlet 12 and an oxygen-gas is supplied to the cathode gas chamber 4 through the oxygen-containing gas inlet 14. The current supplied electrolytically produces mainly chlorine on the insoluble anode 5 in the anode chamber, and the chlorine and the low-concentration brine move out of the electrolytic cell through the anolyte and chlorine gas outlet 13 and are utilized effectively. On the other hand, water from the hydrophilic layer 6 filled with the caustic soda aqueous solution in advance reacts with oxygen existing near the cushion 8 to produce the caustic soda aqueous solution at reaction points of the gas diffusion electrode 7 in the cathode gas chamber. The caustic soda aqueous solution diffuses into the hydrophilic layer 6 in accordance with the concentration gradient and absorbed and retained therein, or flows down on the hydrophilic layer 6, moves out of the electrolytic cell through the outlet 15 and is utilized effectively.

When the produced caustic soda aqueous solution is discharged through the sealing pot 16 at situation in which the salt concentration exceeds 100 ppm or from the beginning of the operation, the gas pressure in the sealing pot corresponding to the pressure of the caustic soda aqueous solution is applied to the cathode gas chamber. The pressurization in the cathode gas chamber can be assured by controlling the opening degree of the valve 17 even if the sealing pot can not be installed. The gas pressure in the cathode gas chamber is managed by the manometer 18. The gas pressure in the cathode gas chamber indicated by the manometer 18 can be controlled constant or over a specified pressure by changing the liquid height of the sealing pot 16 or the opening degree of the valve 17. When the electrolysis is conducted in this manner while the cathode gas chamber is pressurized to make smaller "the liquid pressure in the anode chamber"−"the gas pressure in the cathode gas chamber" (hereinafter referred to as "differential pressure") which is a difference between the liquid pressure in the anode chamber (="height of brine"×"brine density"÷2) and the gas pressure in the cathode gas chamber (the pressure of the oxygen-containing gas), the salt concentration in the caustic soda aqueous solution is maintained below 100 ppm and is reduced to that before exhibiting the upward trend and being maintained stably.

In this text, the liquid pressure in the anode chamber and the gas pressure in the cathode gas chamber may be also refereed to as "the pressure in the anode chamber" and "the pressure in the cathode gas chamber", respectively.

The differential pressure at 2.4 kPa or less preferably generates the downward trend, and the differential pressure at −0.6 kPa or less more preferably generates the large downward trend. The maximum pressure pressurizing the cathode gas chamber is preferably determined in consideration of the pressure of supplying the oxygen-containing gas, the decrease of the production of the caustic soda due to the pressurization of the cathode gas chamber and the withstand strength of the electrolytic cell.

EXAMPLES

While the present invention will be further described with regard to Examples, the present invention shall not be restricted thereto.

Example 1

A two-chamber method GDE (trademark) including a carbon cloth substrate available from Permelec Electrode Ltd. was employed as a gas diffusion electrode. This gas diffusion electrode consisted of polytetrafluoroethylene, silver fine particles and the carbon cloth (carbon fibers) substrate. Carbon fibers available from Permelec Electrode Ltd. were employed as a hydrophilic layer, and DSE (trademark) available from Permelec Electrode Ltd. was employed as an anode.

An unused cation exchange membrane 4404X available from Asahi Kasei Chemicals Corporation was employed.

An electrolytic cell having an electrolysis area of 6 $dm^2$ available from Chlorine Engineers Corp., Ltd. was used. The reaction areas of the electrodes had a width of 100 mm and a height of 600 mm. The components of the electrolytic cell included an anode chamber made of titanium, nickel, a cathode gas chamber made of nickel which was plated with silver, a gasket made of EPDM (ethylene-propylene-diene rubber), and a coil cushion made of nickel which was plated with silver.

A U-shaped tube with a scaled attachment and filled with water measurable in a region from 0 kPa gauge (kPa indicates a gauge pressure, and in a similar fashion hereinafter) to 25 kPa was used as a manometer, and a vessel having a diameter of 200 mm and a height of 2500 mm was used as a sealing pot made of acryl resin.

The electrolytic apparatus shown in FIG. 1 was assembled by stacking the above cathode gas chamber, the coil cushion, the gas diffusion electrode, the hydrophilic layer, the cation exchange membrane, the anode and the anode chamber in this turn.

In the method of the brine electrolysis, saturated brine at 80° C. was supplied to the anode chamber through an anode inlet, and concentrated oxygen (concentration: 93% in volume) obtained by means of PSA was supplied to the cathode gas chamber through a cathode inlet. After the confirmation of the respective supplies of the saturated brine to the anode chamber and the oxygen to the cathode gas chamber, current of 180 A was supplied to both of the electrodes (current density: 3 $kA/m^2$). After the current supply, chlorine and caustic soda were obtained in the anode chamber and the cathode gas chamber, respectively. A temperature at an anode outlet was maintained at 80 to 90° C., and a caustic soda aqueous solution concentration was maintained at 32 to 35%. The liquid height in the anode chamber at this stage was 600 mm, the brine density was 1.12 g/liter and the pressure in the anode chamber was 3.4 kPa.

The salt concentration in the produced caustic soda aqueous solution was measured by employing a spectrophotometric method prescribed in JISK 1200-3-1.

The salt concentration in the caustic soda aqueous solution at a fourth day after the beginning of the electrolysis upon the current supply was excellently 33 ppm which was a concentration value converted into the 50% caustic soda aqueous solution (similarly, the salt concentrations in the caustic soda aqueous solution hereinafter are values converted into the 50% caustic soda aqueous solution). Thereafter, the salt concentrations at a $22^{nd}$ day and a $43^{rd}$ day were excellently 12 ppm and 22 ppm, respectively. Then, the salt concentration drastically increased to 1500 ppm at a $69^{th}$ day. Because of the salt concentration increase, a sealing pot was installed at the outlet of the produced caustic soda aqueous solution to apply a pressure of 4 kPa to the cathode gas chamber to change the differential pressure from 3.4 kPa to −0.6 kPa.

The salt concentration at a $33^{rd}$ day from the beginning of the pressurization of the cathode gas chamber (a $102^{nd}$ day from the beginning of the operation) was 343 ppm, and the decrease of the salt concentration in the caustic soda aqueous solution by the pressurization in the cathode gas chamber was confirmed. Thereafter, the pressure was increased from 4 kPa to 6 kPa, thereby changing the differential pressure from −0.6 kPa to −2.6 kPa. The salt concentration at a sixth day from the beginning of the pressurization of the cathode gas chamber at 6 kPa (a $108^{th}$ day from the beginning of the operation) was 30 ppm, and the salt concentration or the quality could be recovered to the quality before the drastic increase.

The salt concentrations at a $100^{th}$ day and a $200^{th}$ day from the beginning of the pressurization of the cathode gas chamber (a $169^{th}$ day and a $269^{th}$ day from the beginning of the operation) were stable below 30 ppm. It is confirmed that the caustic soda aqueous solution with the excellent quality could be stably produced for a long period of time by the pressurization of the cathode gas chamber.

Example 2

A GDE (trademark) including a foamed nickel substrate plated with silver available from Permelec Electrode Ltd. was employed as a gas diffusion electrode. This gas diffusion electrode consisted of polytetrafluoroethylene, silver fine particles, hydrophilic carbon, hydrophobic carbon and the foamed nickel substrate plated with silver. A hydrophilic layer and an anode were similar to those of Example 1.

An unused cation exchange membrane 8020 available from Asahi Glass Co., Ltd. was employed.

An electrolytic cell, a manometer and a sealing pot were similar to those of Example 1.

An electrolytic apparatus, a method of electrolyzing brine and salt concentration measurement in the caustic soda aqueous solution were similar to those of Example 1. The liquid height of the anode chamber at this stage was 600 mm, the brine density was 1.12 g/liter and the pressure in the anode chamber was 3.4 kPa which was the same as that of Example 1.

The salt concentrations in the caustic soda aqueous solution at a $19^{th}$ day and a $40^{th}$ day after the beginning of the electrolysis upon the current supply were excellently 31 ppm and 49 ppm. Then, the salt concentrations drastically increased to 143 ppm and 769 ppm at a $74^{th}$ day and a $91^{st}$ day. At a $97^{th}$ day, a sealing pot was installed at the outlet of the caustic soda aqueous solution, similarly to Example 1, to apply a pressure of 7 kPa to the cathode gas chamber to change the differential pressure from 3.4 kPa to −3.6 kPa.

The salt concentration at a $21^{st}$ day from the beginning of the pressurization of the cathode gas chamber was 18 ppm, and the decrease of the salt concentration in the caustic soda aqueous solution or its increase of the quality by the pressurization in the cathode gas chamber was confirmed similarly to Example 1.

The salt concentrations at a $100^{th}$ day and a $200^{th}$ day from the beginning of the pressurization of the cathode gas chamber were stable below 30 ppm. It is confirmed similarly to Example 1 that the caustic soda aqueous solution with the excellent quality could be stably produced for a long period of time by the pressurization of the cathode gas chamber.

Example 3

An electrolysis test was conducted on an electrolytic cell available from Chlorine Engineers Corp., Ltd, which included 32 sheets of cation exchange membrane of 1330 mm×2590 mm (unused cation exchange membranes 4403D available from Asahi Kasei Chemicals Corporation), 32 sheets of gas diffusion electrodes (available from. Permelec Electrode, Ltd.) acting as cathodes, and 32 sheets of DSE (trademark) available from Permelec Electrode Ltd. acting as anodes. The electrolytic cell was a monopolar cell having 32 unit cells in which a reaction surface of each unit cell has a width of 2480 mm and a height of 1220 mm.

The cathode gas chamber was pressurized in accordance with a method in which the valve near the outlet for the produced caustic soda aqueous solution as shown in FIG. 1 was opened and closed. The pressure in the electrolytic cell was measured by using a manometer "YAMATAKE DSTJ3000 TRNSMITTER MODEL JTH920A-145A21EC-X1XXX2-A2T1" (available from Yamatake Corporation) mounted on a collecting outlet for the caustic soda aqueous solution.

The electrolysis conditions before and after the pressurization of the cathode gas chamber were such that the supply current was 188 kA (current density: 3.9 A/$m^2$), the outlet temperature of the anode chamber was 80 to 90° C., and a caustic soda aqueous solution concentration was maintained at 32 to 35%. The liquid height in the anode chamber at this stage was 1220 mm, the brine density was 1.12 g/liter and the pressure in the anode chamber was 6.7 kPa.

Three pressure conditions of no pressure, 4 kPa and 6 kPa (corresponding differential pressures were 6.7 kPa, 2.7 kPa and 0.7 kPa, respectively) were employed for cathode gas chamber pressurization. In each condition, the salt concentration in the produced caustic soda aqueous solution was measured.

The results of salt concentration analysis were 28 ppm for the no pressurization, 18 ppm for 4 kPa and 16 ppm for 6 kPa. Accordingly, it is confirmed that the quality of the produced caustic soda aqueous solution could be improved by the cathode gas chamber pressurization.

Examples 4 to 17

The influences by the pressurizations of the cathode gas chamber were examined while the conditions including that the liquid height of the anode chamber was 600 mm, and the brine density was 1.12 g/liter to adjust the pressure in the anode chamber to be 3.4 kPa were the same as those of Example 1 except for the pressurizations of the cathode gas chamber (Examples 4 to 17).

In each of Examples similar to the preceding Examples, the cathode gas chamber was not pressurized in the early stage of the electrolysis, and when the salt concentration in the produced caustic soda aqueous solution in the cathode gas chamber was detected to be 1500 ppm, the cathode gas chamber was pressurized by the same manner as that of Example 1 to change the differential pressure from 3.4 kPa at the no pressurization of the cathode chamber to 2.8 kPa (Example 4), to 2.5 kPa (Example 5), to 2.4 kPa (Example 6), to 2.2 kPa (Example 7), to 1.8 kPa (Example 8), to 1.4 kPa (Example 9), to −0.6 kPa (Example 10), to −2.6 kPa (Example 11), to −4.6 kPa (Example 12), to −6.6 kPa (Example 13), to −9.6 kPa (Example 14), to −11.6 kPa (Example 15), to −12.6 kPa (Example 16) and to −21.6 kPa (Example 17).

Figure 2:
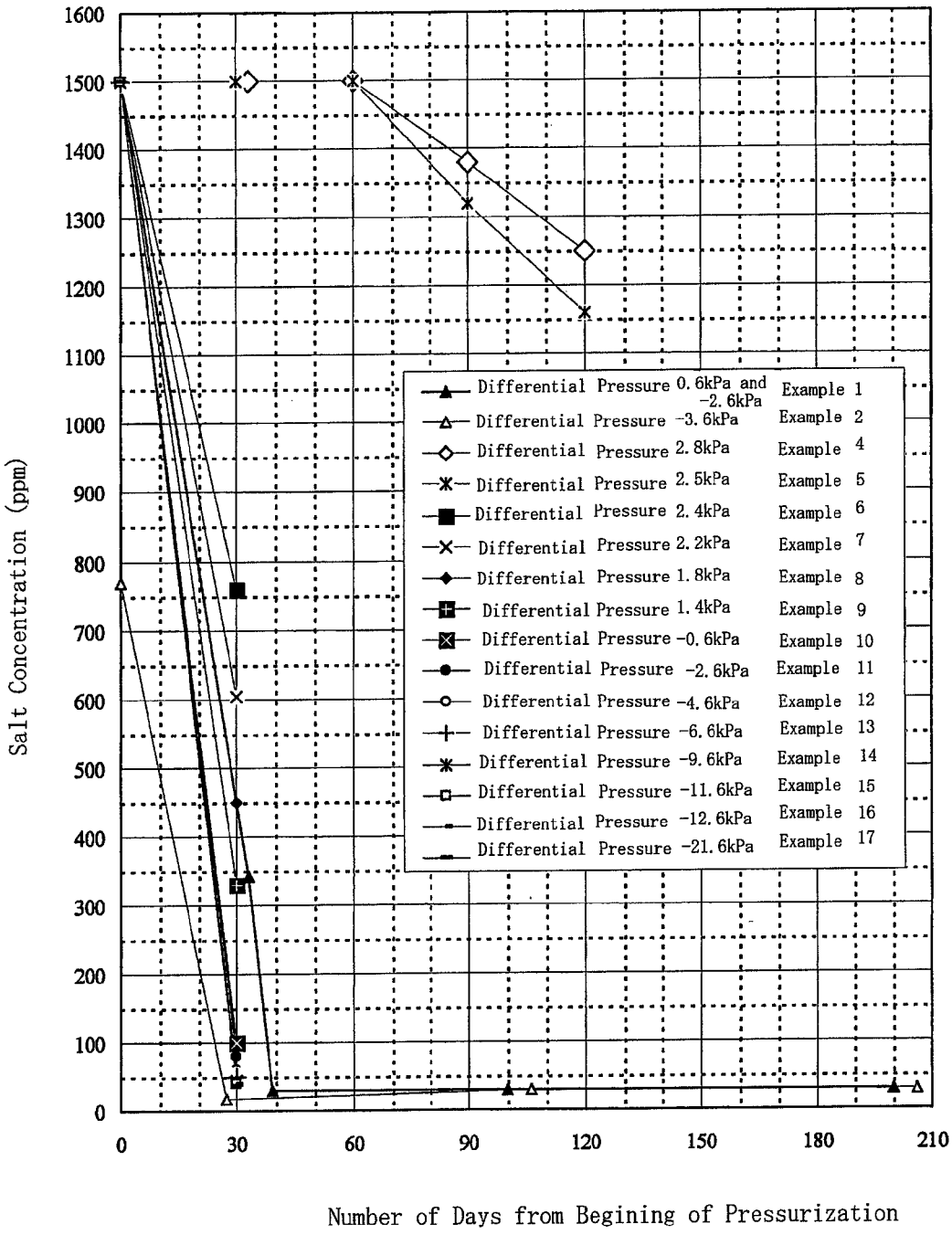
FIG. 2 is a graph showing the relation between the number of days from the beginning of pressurization and a salt concentration in Examples 1, 2 and 4 to 17.

The relations between the number of days of no pressurization and from the beginning of pressurization and the salt concentrations in the caustic soda aqueous solution in each of Examples are shown in Table 1 in which "anode chamber pressure" refers to "liquid pressure in anode chamber", and "cathode chamber pressure" refers to "gas pressure in cathode gas chamber". The relations between the number of days from the beginning of pressurization and the salt concentrations in the caustic soda aqueous solution in each of Examples including Examples 1 and 2 (excluding Example 3) are shown a graph of FIG. 2.

TABLE 1

| | Electrolytic cell | | | Anode Chamber | Cathode Chamber | Diffrential |
|---|---|---|---|---|---|---|
| | Surface Area | Width | Height | Pressure kPaG | Pressure kPaG | Pressure kPaG |
| Ex. 1 | 6 $dm^2$ | 100 mm | 600 mm | 3.4 | 0 | 3.4 |
| | | | | | 4.0 | −0.6 |
| | | | | | 6.0 | −2.6 |
| Ex. 2 | 6 $dm^2$ | 100 mm | 600 mm | 3.4 | 0 | 3.4 |
| | | | | | 7.0 | −3.6 |
| Ex. 3 | 3.03 $m^2$ | 2480 mm | 1220 mm | 6.7 | 0 | 6.7 |
| | | | | | 4.0 | 2.7 |
| | | | | | 6.0 | 0.7 |

TABLE 1-continued

| | | | | | | |
|---|---|---|---|---|---|---|
| Ex. 4 | 6 $dm^2$ | 100 mm | 600 mm | 3.4 | 0 | 3.4 |
| | | | | | 0.6 | 2.8 |
| Ex. 5 | 6 $dm^2$ | 100 mm | 600 mm | 3.4 | 0 | 3.4 |
| | | | | | 0.9 | 2.5 |
| Ex. 6 | 6 $dm^2$ | 100 mm | 600 mm | 3.4 | 0 | 3.4 |
| | | | | | 1.0 | 2.4 |
| Ex. 7 | 6 $dm^2$ | 100 mm | 600 mm | 3.4 | 0 | 3.4 |
| | | | | | 1.2 | 2.2 |
| Ex. 8 | 6 $dm^2$ | 100 mm | 600 mm | 3.4 | 0 | 3.4 |
| | | | | | 1.6 | 1.8 |
| Ex. 9 | 6 $dm^2$ | 100 nm | 600 mm | 3.4 | 0 | 3.4 |
| | | | | | 2.0 | 1.4 |
| Ex. 10 | 6 $dm^2$ | 100 mm | 600 mm | 3.4 | 0 | 3.4 |
| | | | | | 4.0 | −0.6 |
| Ex. 11 | 6 $dm^2$ | 100 mm | 600 mm | 3.4 | 0 | 3.4 |
| | | | | | 6.0 | −2.6 |
| Ex. 12 | 6 $dm^2$ | 100 mm | 600 mm | 3.4 | 0 | 3.4 |
| | | | | | 8.0 | −4.6 |
| Ex. 13 | 6 $dm^2$ | 100 mm | 600 mm | 3.4 | 0 | 3.4 |
| | | | | | 10 | −6.6 |
| Ex 14 | 6 $dm^2$ | 100 mm | 600 mm | 3.4 | 0 | 3.4 |
| | | | | | 13.0 | −9.6 |
| Ex 151 | 6 $dm^2$ | 100 mm | 600 mm | 3.4 | 0 | 3.4 |
| | | | | | 15.0 | −11.6 |
| Ex 16 | 6 $dm^2$ | 100 mm | 600 mm | 3.4 | 0 | 3.4 |
| | | | | | 16.0 | −12.6 |
| Ex. 17 | 6 $dm^2$ | 100 mm | 600 mm | 3.4 | 0 | 3.4 |
| | | | | | 25.0 | −21.6 |

| | The Number of Days Salt Concentration (ppm) | | | | | | | | Amount of Produced Caustic Soda | Situation of Electrolytic Cell |
|---|---|---|---|---|---|---|---|---|---|---|
| Ex. 1 | 4 | 22 | 43 | 69 | | | | | | |
| | 33 | 12 | 22 | 1500 | | | | | | |
| | | | | | 102 | | | | | |
| | | | | | 343 | | | | | |
| | | | | | | 108 | 169 | 269 | | |
| | | | | | | 30 | below 30 | below 30 | | |
| Ex. 2 | 19 | 40 | 74 | 91 | | | | | | |
| | 31 | 49 | 143 | 769 | | | | | | |
| | | | | | 97 | 118 | 197 | 297 | | |
| | | | | | | 18 | below 30 | below 30 | | |
| Ex. 3 | 0 | | | | | | | | | |
| | 28 | | | | | | | | | |
| | | 4 | | | | | | | | |
| | | 18 | | | | | | | | |
| | | | 6 | | | | | | | |
| | | | 16 | | | | | | | |
| Ex. 4 | 4 | 22 | 43 | 69 | | | | | | |
| | 33 | 12 | 22 | 1500 | | | | | | |
| | | | | | 102 | 129 | 159 | 189 | | |
| | | | | | 1500 | 1500 | 1380 | 1250 | | |
| Ex. 5 | 62 | | | | | | | | | |
| | 1500 | | | | | | | | | |
| | | 92 | 122 | 152 | 182 | | | | | |
| | | 1500 | 1500 | 1320 | 1160 | | | | | |
| Ex. 6 | 65 | | | | | | | | | |
| | 1500 | | | | | | | | | |
| | | 95 | | | | | | | | |
| | | 760 | | | | | | | | |
| Ex. 7 | 65 | | | | | | | | | |
| | 1500 | | | | | | | | | |
| | | 95 | | | | | | | | |
| | | 605 | | | | | | | | |
| Ex. 8 | 65 | | | | | | | | | |
| | 1500 | | | | | | | | | |
| | | 95 | | | | | | | | |
| | | 450 | | | | | | | | |
| Ex. 9 | 60 | | | | | | | | | |
| | 1500 | | | | | | | | | |
| | | 90 | | | | | | | | |
| | | 330 | | | | | | | | |
| Ex. 10 | 70 | | | | | | | | | |
| | 1500 | | | | | | | | | |
| | | 100 | | | | | | | | |
| | | 100 | | | | | | | | |

TABLE 1-continued

| | | | | |
|---|---|---|---|---|
| Ex. 11 | 60 | | | |
| | 1500 | | | |
| | | 90 | | |
| | | 80 | | |
| Ex. 12 | 58 | | | |
| | 1500 | | | |
| | | 88 | | |
| | | 60 | | |
| Ex. 13 | 60 | | | |
| | 1500 | | | |
| | | 90 | | |
| | | 50 | | |
| Ex 14 | 65 | | | |
| | 1500 | | | |
| | | 95 | | |
| | | 45 | | |
| Ex 151 | 68 | | | |
| | 1500 | | | |
| | | 98 | | |
| | | 40 | | |
| Ex 16 | 62 | | | |
| | 1500 | | | |
| | | 92 | | |
| | | 40 | Reduction by 10% | |
| Ex. 17 | 62 | | | |
| | 1500 | | | |
| | | 92 | | |
| | | 38 | Large Decrease | Deformation |

Further, in each of Examples, the relations between the number of days from the beginning of the pressurization and the salt concentrations in the caustic soda aqueous solution were continuously measured, and the salt concentrations in the caustic soda aqueous solution at the beginning of the pressurization, after the lapse of 1 day, 10 days and 30 days are summarized in Table 2. The downward gradients (ppm/day) of the salt concentrations in each of Examples calculated by using the above data were summarized in Table 2. In Examples 4 and 5, the data after a $60^{th}$ day (a $129^{th}$ day from the beginning of the operation in Example 4, and a $122^{nd}$ day from the beginning of the operation in Example 5) were used (the same in Examples 3 to 5 below).

TABLE 2

Decrease of Salt Concentration by Cathode Gas Chamber Pressurization

| Example | Anode Chamber Pressure (kPa) | Cathode Gas Chamber Pressure (kPa) | Differential Pressure (kPa) | Gradient of Decrease of Salt Concentration (ppm/day) | Number of Days Elapsed and Salt Concentration (ppm) 1 day | 10 days | 30 days |
|---|---|---|---|---|---|---|---|
| 4 | 3.4 | 0.6 | 2.8 | −4.2 | 1496 | 1458 | 1374 |
| 5 | 3.4 | 0.9 | 2.5 | −5.7 | 1494 | 1443 | 1329 |
| 6 | 3.4 | 1.0 | 2.4 | −24.7 | 1475 | 1253 | 760 |
| 7 | 3.4 | 1.2 | 2.2 | −29.8 | 1470 | 1202 | 605 |
| 8 | 3.4 | 1.6 | 1.8 | −35.0 | 1465 | 1150 | 450 |
| 9 | 3.4 | 2.0 | 1.4 | −39.0 | 1461 | 1110 | 330 |
| 10 | 3.4 | 4.0 | −0.6 | −46.6 | 1454 | 1034 | 100 |
| 11 | 3.4 | 6.0 | −2.6 | −47.3 | 1453 | 1027 | 80 |
| 12 | 3.4 | 8.0 | −4.6 | −48.0 | 1452 | 1020 | 60 |
| 13 | 3.4 | 10.0 | −6.6 | −48.3 | 1452 | 1017 | 50 |
| 14 | 3.4 | 13.0 | −9.6 | −48.5 | 1452 | 1015 | 45 |
| 15 | 3.4 | 15.0 | −11.6 | −48.7 | 1451 | 1013 | 40 |
| 16 | 3.4 | 16.0 | −12.6 | −48.7 | 1451 | 1013 | 40 |
| 17 | 3.4 | 25.0 | −21.6 | −48.7 | 1451 | 1013 | 38 |

(Gradient, Number of Days Elapsed at 1500 ppm Base and Salt Concentration

Remarks)

In Examples 4 and 5, the data after a $60^{th}$ day from the beginning of the operation were used.

The cathode gas chamber pressures and the number of days required for decreasing the salt concentrations in the caustic soda aqueous solutions from 1500 ppm to 100 ppm were calculated and summarized in Table 3. Further, the number of days required for decreasing the salt concentrations from 100 ppm to 50 ppm were calculated and summarized in Table 4. Further, the required times for decreasing the salt concentrations by 10 ppm (from 30 ppm to 20 ppm) were calculated and summarized in Table 5.

TABLE 3

Number of Days Required for Decrease from 1500 ppm to 100 ppm

| Example | Anode Chamber Pressure (kPa) | Cathode Chamber Pressure (kPa) | Differential Pressure (kPa) | Number of Days Elapsed (days) |
|---|---|---|---|---|
| 4 | 3.4 | 0.6 | 2.8 | 396 |
| 5 | 3.4 | 0.9 | 2.5 | 307 |
| 6 | 3.4 | 1.0 | 2.4 | 57 |
| 7 | 3.4 | 1.2 | 2.2 | 47 |
| 8 | 3.4 | 1.6 | 1.8 | 40 |
| 9 | 3.4 | 2.0 | 1.4 | 36 |
| 10 | 3.4 | 4.0 | −0.6 | 30 |
| 11 | 3.4 | 6.0 | −2.6 | 30 |
| 12 | 3.4 | 8.0 | −4.6 | 29 |
| 13 | 3.4 | 10.0 | −6.6 | 29 |
| 14 | 3.4 | 13.0 | −9.6 | 29 |
| 15 | 3.4 | 15.0 | −11.6 | 29 |
| 16 | 3.4 | 16.0 | −12.6 | 29 |
| 17 | 3.4 | 25.0 | −21.6 | 29 |

Remarks)
In Examples 4 and 5, the data after a 60$^{th}$ day from the beginning of the operation were used.

TABLE 4

Number of Days Required for Decrease from 100 ppm to 50 ppm

| Example | Anode Chamber Pressure (kPa) | Cathode Chamber Pressure (kPa) | Differential Pressure (kPa) | Number of Days Elapsed (days) |
|---|---|---|---|---|
| 4 | 3.4 | 0.6 | 2.8 | 11.9 |
| 5 | 3.4 | 0.9 | 2.5 | 8.77 |
| 6 | 3.4 | 1.0 | 2.4 | 2.02 |
| 7 | 3.4 | 1.2 | 2.2 | 1.68 |
| 8 | 3.4 | 1.6 | 1.8 | 1.43 |
| 9 | 3.4 | 2.0 | 1.4 | 1.28 |
| 10 | 3.4 | 4.0 | −0.6 | 1.07 |
| 11 | 3.4 | 6.0 | −2.6 | 1.06 |
| 12 | 3.4 | 8.0 | −4.6 | 1.04 |
| 13 | 3.4 | 10.0 | −6.6 | 1.04 |
| 14 | 3.4 | 13.0 | −9.6 | 1.03 |
| 15 | 3.4 | 15.0 | −11.6 | 1.03 |
| 16 | 3.4 | 16.0 | −12.6 | 1.03 |
| 17 | 3.4 | 25.0 | −21.6 | 1.03 |

Remarks)
In Examples 4 and 5, the data after a 60$^{th}$ day from the beginning of the operation were used.

TABLE 5

Required Time for Decrease by 10 ppm (from 30 to 20 ppm)

| Example | Anode Chamber Pressure (kPa) | Cathode Chamber Pressure (kPa) | Differential Pressure (kPa) | Required Hours (hr) |
|---|---|---|---|---|
| 4 | 3.4 | 0.6 | 2.8 | 57.1 |
| 5 | 3.4 | 0.9 | 2.5 | 42.1 |
| 6 | 3.4 | 1.0 | 2.4 | 9.7 |

TABLE 5-continued

Required Time for Decrease by 10 ppm (from 30 to 20 ppm)

| Example | Anode Chamber Pressure (kPa) | Cathode Chamber Pressure (kPa) | Differential Pressure (kPa) | Required Hours (hr) |
|---|---|---|---|---|
| 7 | 3.4 | 1.2 | 2.2 | 8.1 |
| 8 | 3.4 | 1.6 | 1.8 | 6.9 |
| 9 | 3.4 | 2.0 | 1.4 | 6.2 |
| 10 | 3.4 | 4.0 | −0.6 | 5.2 |
| 11 | 3.4 | 6.0 | −2.6 | 5.1 |
| 12 | 3.4 | 8.0 | −4.6 | 5.0 |
| 13 | 3.4 | 10.0 | −6.6 | 5.0 |
| 14 | 3.4 | 13.0 | −9.6 | 5.0 |
| 15 | 3.4 | 15.0 | −11.6 | 5.0 |
| 16 | 3.4 | 16.0 | −12.6 | 5.0 |
| 17 | 3.4 | 25.0 | −21.6 | 5.0 |

Remarks)
In Examples 4 and 5, the data after a 60$^{th}$ day from the beginning of the operation were used.

Table 2 reveals that the salt concentrations in the produced caustic soda aqueous solutions could be decreased at an average downward gradient from −4.2 ppm/day to −48.7 ppm/day when the electrolysis was conducted while the cathode gas chamber was pressurized. Further, Table 3 reveals that 1500 ppm which was the salt concentrations in the produced caustic soda aqueous solutions could be decreased to 100 ppm which was preferable in a practical sense in 29 to 396 days.

It is understandable that while the average downward gradient of the salt concentration was −5.7 ppm/day and the number of days required to decrease the salt concentration from 1500 ppm to 100 ppm was 307 days in Example 5 in which the pressurization was conducted at 0.9 kPa, the average downward gradient and the number of days were −24.7 ppm/day and 57 days in Example 6 in which the pressurization was conducted at 1.09 kPa, so that the critical value of the cathode gas chamber pressurization existed between 0.9 kPa and 1.0 kPa.

The upper limit of the pressurization is preferably determined in consideration of an amount of the caustic soda reduction caused by the cathode gas chamber pressurization and the withstand strength of the electrolytic cell because while the decrease rate of the salt concentration increased with the increase of the pressure at the pressure up to 15 kPa, the decrease rate of the salt concentration remained nearly unchanged in addition to the occurrences of the decrease of the caustic soda production and of the deformation of the components of the electrolytic cell at the pressure above 15 kPa (16 kPa of Example 16 and 25 kPa of Example 17). Examples in Table 1 having no remarks in the columns of "amount of produced caustic soda" and "situation of electrolytic cell" show that these Examples accompanied neither "the reduction of the amount of the produced caustic soda" nor "the deformation of the electrolytic cell components".

Tables 4 and 5 show that the restoration could be attained in a relatively short period of time by the cathode gas chamber pressurization when the salt concentration increase in the caustic soda aqueous solution was small. Especially, as shown in Table 5, it is practically effective that the restoration to the normal situation could be attained below 10 hours by applying the differential pressure of 2.4 kPa or less in case of about 10 ppm increase of the salt concentration.

The invention claimed is:

1. A method of electrolyzing brine using a two-chamber ion exchange membrane electrolytic cell divided, by an ion exchange membrane, into an anode chamber equipped with an anode and a cathode gas chamber equipped with a gas diffusion electrode, the method comprising:

supplying an oxygen-containing gas to the cathode gas chamber through an oxygen-containing gas inlet, and a sealing pot or a valve downstream of an outlet of the cathode gas chamber for a caustic soda aqueous solution and the oxygen-containing gas; and reducing a differential pressure from a non-pressurized state by pressurizing an inside of the cathode gas chamber by changing a liquid height of the sealing pot or an opening degree of the valve, the differential pressure being a difference between a liquid pressure in the anode chamber and a gas pressure in the cathode gas chamber, thereby decreasing a salt concentration in the caustic soda aqueous solution that is electrolytically produced, wherein the differential pressure is reduced to 2.4 kPa or less by pressurizing the inside of the cathode gas chamber.

2. The method of electrolyzing brine as claimed in claim 1, wherein the differential pressure is reduced to −21.6 kPa or more by pressurizing the inside of the cathode gas chamber.

3. A method of producing a chlorine gas, the method comprising:

producing the chlorine gas using the method of electrolyzing brine as claimed in claim 2.

4. A method of producing caustic soda, the method comprising:

producing the caustic soda using the method of electrolyzing brine as claimed in claim 2.

5. The method of electrolyzing brine as claimed in claim 1, wherein a gas pressure of the oxygen-containing gas in the cathode gas chamber is increased to pressurize the inside of the cathode gas chamber.

6. A method of producing a chlorine gas, the method comprising:

producing the chlorine gas using the method of electrolyzing brine as claimed in claim 1.

7. A method of producing caustic soda, the method comprising:

producing the caustic soda using the method of electrolyzing brine as claimed in claim 1.

8. The method of electrolyzing brine as claimed in claim 1, wherein the oxygen-containing gas is supplied to the cathode gas chamber through the oxygen-containing gas inlet without liquid.

* * * * *